US006588194B2

(12) United States Patent
Kriegler et al.

(10) Patent No.: US 6,588,194 B2
(45) Date of Patent: Jul. 8, 2003

(54) PROCESS AND APPARATUS FOR LEVEL ADJUSTMENT OF THE CAN PLATE OF A SPINNING CAN

(75) Inventors: Albert Kriegler, Geisenfeld (DE); Frank Ficker, Reichertshofen/Ronnweg (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/044,308

(22) Filed: Oct. 22, 2001

(65) Prior Publication Data

US 2002/0116913 A1 Aug. 29, 2002

(51) Int. Cl.[7] ..... D01H 13/26
(52) U.S. Cl. ..... 57/281; 19/159 A; 19/195 R
(58) Field of Search ..... 19/65 A, 150, 19/157, 159 A, 159 R; 57/90, 281; 53/255, 430, 475, 536

(56) References Cited

U.S. PATENT DOCUMENTS

| | | | | |
|---|---|---|---|---|
| 2,018,261 A | | 10/1935 | Holdsworth | |
| 3,053,410 A | | 9/1962 | Eaddy | |
| 4,133,079 A | | 1/1979 | Kriechbaum et al. | |
| 5,237,726 A | * | 8/1993 | Gartenmann et al. | 19/159 A |
| 5,446,946 A | | 9/1995 | Leifeld | |
| 5,450,656 A | * | 9/1995 | Ueding et al. | 19/159 R |
| 5,575,040 A | * | 11/1996 | Leifeld et al. | 19/159 A |
| 5,829,100 A | * | 11/1998 | Stentenbach | 19/159 R |
| 5,937,484 A | * | 8/1999 | Sramek et al. | 19/159 A |
| 6,182,425 B1 | | 2/2001 | Ficker et al. | |

FOREIGN PATENT DOCUMENTS

| | | |
|---|---|---|
| EP | 0255880 | 2/1988 |
| EP | 0344484 | 12/1989 |

OTHER PUBLICATIONS

Patent Abstract of Japan, Mar. 7, 1995.
German Patent Office Search Report, Jan. 10, 2001.

* cited by examiner

*Primary Examiner*—Gary L Welch
(74) *Attorney, Agent, or Firm*—Dority & Manning

(57) ABSTRACT

A process for the level adjustment of the can plate of a sliver can is proposed which is in a filling position at the output of a textile machine to be filled with fiber sliver F. The can plate is moved before the start of the filling process by a first moving device from a lower can plate position into a higher can plate position and is moved into the lower can plate position during the filling of the sliver can. The process according to the invention is characterized in that the can plate is moved before the start or during the starting phase of the filling process by a second moving device from the higher can plate position into an upper filling position after the sliver can enters a position to accept sliver from the textile machine. Furthermore, a suitable apparatus to perform the process is presented.

24 Claims, 6 Drawing Sheets

User Table

| USER ID | NAME | E-MAIL | • • • |
|---|---|---|---|
| J. Smith | Smith, J. | jsmith@... | |
| J. Doe | Doe, J. | jdoe@... | |
| • | | | |
| • | | | |
| • | | | |

501

Context Mapping Table

| USER ID | CONTEXT ID |
|---|---|
| J. Smith | 204 |
| J. Smith | 220 |
| J. Doe | 229 |
| J. Doe | 205 |
| J. Doe | 175 |
| • | • |
| • | • |
| • | • |

502

*FIG. 5*

Context Table

| CONTEXT ID | NAME | ADDRESS | • • • |
|---|---|---|---|
| 175 | Work | 4215... | |
| 204 | Johnny's | | |
| 205 | Fiction | | |
| 220 | Mother-in-law | | |
| 229 | Non-fiction | | |
| • | • | | |
| • | • | | |
| • | • | | |

503

PROCESS AND APPARATUS FOR LEVEL ADJUSTMENT OF THE CAN PLATE OF A SPINNING CAN

BACKGROUND OF THE INVENTION

The present invention relates to a process as well as to an apparatus for the level adjustment of the can plate of a sliver can which is placed in a filling position at the output of a textile machine in order to be filled with a fiber sliver. The can plate is moved by a first moving device from a lower can plate position to a higher can plate position before the start of the filling process. The can is moved or can be moved into the lower can plate position during the filling of the can.

Such processes and devices are known in great numbers in the textile industry. In one widely used spinning can with a round cross-section, the lateral walls of the spinning can surround at least one helicoidal spring provided as a moving device pressing from below against the can plate. When the can is empty, the can plate is ideally lifted to the upper can edge. During the filling of the can with textile material, the can plate is gradually lowered through the weight of the filling material. In the same manner, spinning cans with rectangular cross-section are known, where usually two helicoidal springs are located next to each other in the longitudinal direction of the can. To stabilize the can plate in a horizontal position, a pantograph system or slidable lattice grate system is usually provided for these cans.

It is a disadvantage with these known devices that the splings in the spinning cans wear out in time, so that the can plate is no longer sufficiently lifted into its upper filling position when the can is empty. If the can is used at the output of a drafting arrangement, for example, the distance from the fiber sliver-feeding machine element to the can plate is too great. Consequently, the fiber sliver end is no longer deposited in an orderly manner but slips uncontrolled on the can plate. Tolerances in springs, including the material, length and constant elasticity, must be selected with relatively great precision in order to achieve a precise force effect upon the can plate for precise positioning at the upper can edge before the start of the filling process or similar consequences will occur.

In all of the above-mentioned cases, the fiber sliver deposited at the beginning of the filling process is of relatively low quality, as insufficient frictional engagement exists between the feeding machine element (in the case of a drafting arrangement this is a sliver channel in a rotary table) and the can plate. With the trend towards ever larger cans, above-mentioned difficulties intensify since a greater quantity of material of insufficient quality is filled into the sliver can at the beginning of the depositing process.

In order to avoid the above-mentioned effects as much as possible, the rotary table and the can are often accelerated at only a slow paced in the beginning of the depositing process. In that case, the productivity of the textile machine is lowered.

OBJECTS AND SUMMARY OF THE INVENTION

A principal object of the present invention is to further develop a process or an apparatus of the type mentioned above in such manner that the sliver quality of the sliver is improved in such manner that at the beginning of the filling process, i.e., during the running up of the textile machine, the sliver quality is improved independently of the state or position of the first moving device at the sliver can used.

Additional objects and advantages of the invention will be set forth in part in the following description, or may be obvious from the description, or may be learned through practice of the invention.

This principal object is attained in the process of the type mentioned initially in that the can plate is moved by a second moving device from the higher can plate position into an upper filling position before the start or in the starting phase of the filling process.

Furthermore, the object is attained with the apparatus of the type mentioned initially in that a second moving device is provided in order to move the can plate from the higher can plate position to an upper filling position as the can is in filling position, before or in the starting phase of the filling process.

The advantages of the invention are to be found especially in the fact that the can plate can be moved by means of the second moving device into an optimal position at the beginning of the depositing process. If cans with inserted springs are used as the first moving device, spring wear and a resulting undesirable low position of the can plate as well as deviations from spring tolerances can be compensated for. The frictional engagement between the fiber sliver deposited on the can plate and the rotary plate can be optimized by means of the invention at the beginning of the depositing process. Uncontrolled slipping of the fiber sliver is avoided, and thereby the quality of this fiber sliver segment is improved. Last but not least, the textile machine can therefore be switched over to its higher speed sooner, so that not only better sliver quality but also greater productivity is the result.

Generally, the invention can be used for all possible sliver can models, in particular, for round cans as well as for rectangular cans. The invention can also be used with different spinning machines with drafting equipment, e.g., draw frames and cards.

The overwhelming advantage of the process according to the invention consists in the fact that the can plate is lifted by means of the second moving device into the upper filling position. As mentioned before, this is useful in particular with worn-out springs, in order to achieve sufficient frictional engagement between can plate and the fiber sliver to be deposited. The invention can however also be advantageously used when the can plate is pushed out too far from the can due to excessively strong springs. In this case, the can plate can also be lowered to the optimal level according to the invention.

The invention can also be used for a textile machine where the can plate is raised and lowered by means of an external lifting device as the first moving device. In this case, the lifting device attaches for example at two projections at the front of the can plate that extend through the can wall. Alternatively, the can plate is lifted without contact by means of a force field. In these embodiments, the second moving device according to the invention can make it possible to achieve a fine-tuned positioning of the can plate.

The second moving device is designed preferably so as to be capable of traveling, in particular in a vertical direction. In this way, the second moving device can be brought to the position of the can plate into which the latter has been moved by the first moving device. Subsequently, the can plate can be moved into the upper filling position by actuating the second moving device. A horizontal traveling capability of the second moving device can also be advantageously used, e.g., in order to bring it laterally closer to the can or to the can plate. A combination of horizontal and vertical travel capability of the second moving device is also advantageous.

The additional force exerted by the second moving device is preferably of a magnetic, mechanical and/or pneumatic nature. A great number of variants are possible here in order to produce the additional force. It is advantageous if the moving device in question is designed so as to be space saving and efficient.

This positioning force preferably no longer takes any effect when a given quantity of fiber sliver has been deposited on the can plate and the can plate must therefore be moved out of the upper filling position. This requires that the positioning force be selected so as to be either constant and not too great, or that it may gradually decrease or increase as the degree of fullness of the can increases. This depends on the force ratios of all the forces acting upon the can plate and upon the fiber sliver deposited on it. After a certain distance covered by the can plate, the spring force alone assumes the moving of the can plate—where a sliver can equipped with springs is used—in order to maintain it at a given level and to ensure sufficient frictional engagement between the fiber sliver segment about to be deposited and the uppermost already deposited fiber sliver segment.

In the simplest embodiment in this respect, the weight of the can plate and of the deposited fiber sliver overcomes the force exerted by the second moving device as filling progresses, and moves out of its area of influence or force field after covering a given distance.

Alternatively, a distance sensor, e.g., a light barrier, is used and emits a signal when a given vertical position of the can plate has been reached in order to switch off the second moving device.

In another alternative embodiment, the effect of force is stopped by the second moving device when the fiber sliver deposited on the can plate exceeds a predetermined weight. In this case, a weight sensor is advantageously provided to measure the weight of the can plate and of the fiber sliver deposited on it. If a given weight that can be predetermined or has been predetermined is exceeded, the positioning force is switched off.

For the above-described events, in particular, a suitably designed control or regulating system is provided which preferably uses a microchip and a corresponding control program.

In an especially preferred embodiment, the second moving device is located outside the can, so that not every can need be equipped with the moving device. Instead, the second moving device is preferred or is located in proximity of the textile machine. The second moving device is preferably designed so that even older textile machines—be they, e.g., cards or draw frames—can be retrofitted with the apparatus according to the invention.

An especially advantageous embodiment of the invention provides for the second moving device and a can plate movement element or part connected to the can plate or to an element supporting the can plate to be magnetic or magnetizable, whereby the second moving device and the movement element having opposite poles. Permanent magnets, iron magnets or electrical magnets can be used for this on the sides of the second moving device. For the equivalent device on the side of the can plate or of the element supporting the can plate, the same types of magnets in principle are to be used. For the sake of simplicity and cost, it is, however, advisable in this case to use a simple permanent magnet. In order to avoid excessive weight of the magnet on the can side, it should preferably have smaller dimensions than the can plate diameter. To avoid, as much as possible, a tilting of the can plate due to the positioning force, the magnet on the side of a round can preferably has a round cross-section as well and is centered relative to the can plate.

In advantageous variant of the invention, the second moving device is installed in the covering plate and/or in the rotary plate above the can plate. This design is possible when cylindrical cans with a small diameter, for example, are to be filled, so that a so-called depositing of the fiber sliver takes place over the center of the can plate. The vertical can axis intersects the rotary plate at any point in time in such small cans, whereby the end of the sliver channel on the side of the can runs periodically through the vertical can axis. The vertical axes of the rotary plate and those of the can do not coincide, however, because of the desired cycloidal depositing of the fiber sliver in the can. Since the rotary plate as well as the can are offset as the can is filled in a rotary motion, the positions of the magnets on the machine side and on the can side change constantly relative to each other. Therefore, in order to bring the magnets of machine and can as close together as possible, the magnet or magnets on the machine side and the magnet or magnets on the can side (either magnetic or magnetizable) are preferably placed in the proximity of the respective vertical axis of the rotary plate and of the can plate, preferably symmetrically and in such manner that they are at least partially one above the other at any point in time. In this manner, an efficient force application is ensured on the one hand, and, on the other hand, tilting of the can plate due to excessive out-of-center forces acting upon the can plate is avoided.

Especially with the device described above, the fact must be taken into consideration that the fiber sliver to be deposited is located between the magnets on the machine side and the can plate. For this reason, the can plate must be kept at a distance from the magnets on the machine side. For this purpose, a distance holder inside or outside the can is preferably provided and is actively connected to the can plate in order to retain the can plate in the can. An especially simple solution provides for a retention cord to be used. It could be attached at one end on the can side, for example, at the lower can wall—which could be continuous or discontinuous—and at the other end at the can plate and would hold the can plate at the level of the upper can edge when taut.

A distance holder is also advantageous considering the different can models used and the utilization of all the different second moving devices. Such a distance holder makes it generally possible to ensure that the can plate remains in the can, be it due to the first and/or the second moving element or under some other influence.

In an alternative embodiment of the invention, the second moving element is located laterally next to the rotary plate and above the can plate. Such an embodiment is used when cylindrical cans with relatively large diameter are to be filled. In this case, the fiber sliver is deposited at the center of the can plate without having the sliver channel end on the can side sweeping over this center. Under such conditions, the vertical can axis never intersects the rotary plate. Instead, the rotary plate—contrary to the fiber sliver deposit described above, over the center of the can plate—is located rather at the can edge, so that placing the machine-side magnets on the rotary plate would easily result in a tilting of the can plate. In addition, the magnet on the can side would have to have a relatively large diameter to approximate the rotary plate, and would therefore be relatively heavy. For these reasons, the magnet on the machine side—or, in general, the second moving device—is preferably located next to the rotary plate and acts on the can plate in proximity of the vertical can axis. In this case, a tilting of the can plate is nearly impossible.

Especially with the variant of the invention described last, it is possible to bring the second moving device into physical contact with the can plate, whereby it must be ensured that the moving device is able to follow the rotary can movement during filling. The physical contact constitutes preferably a frictional engagement between the second moving device and the can plate and takes place preferably before the start of the depositing process of the fiber sliver. The second moving device is preferably also designed in such manner that it is able to follow the vertical movement of the can plate for at least a certain distance until either a release signal is triggered or the can plate and the deposited fiber sliver become too heavy, so that the physical contact is interrupted.

In addition, or alternatively, the second moving device is designed in such manner that it is able to act laterally upon the can plate or upon the element which supports the can plate. An arrangement in which the moving elements are at least in part located on the side of the can provides for favorable spatial conditions so that narrow passages affecting the machine parts putting out the fiber sliver are avoided.

In an advantageous embodiment of the invention, the laterally acting moving acts via magnetic forces upon the lateral walls of the can plate which are then also designed so as to be magnetic and which are crimped advantageously for this purpose so as to extend essentially vertically away from the horizontal contact surface of the can plate.

Alternatively, the second moving device can be designed so that it can be brought into frictional engagement with the can plate or with the element supporting the can plate. In this case, it is advisable to provide at least one opening, but preferably two openings across from each other, in the can wall so that the second moving device can act upon the can plate or upon the element supporting the can plate. The second moving device, which is preferably made in the form of a lifting arrangement with lifting arms, reaches through the can wall to grasp the can plate. Alternatively, the can plate or the previously mentioned element is provided with projections which in turn extend through the can wall and can be brought into frictional engagement with the lifting arrangement.

In a special embodiment, the second moving device comprises a roller arrangement, whereby the roller or rollers can be brought into frictional engagement with the lateral walls of the can plate or with the element supporting the can plate. In this case, the rollers extend preferably through one or several openings in the can wall towards the can plate or the element supporting it.

Instead of magnetic or purely mechanical means being used to move the can plate into the upper filling position, the second moving device can also be used to produce a pressure flow. The pressure flow, e.g., produced from compressed air, is in that case directed from below against the can plate in order to lift it up. By adjusting the force exerted by the pressure flow, a slow lowering of the can plate during the filling process can be achieved. In this embodiment of the invention, the can is advantageously at least partially open at the bottom so that the pressure flow can be directed upon the can plate.

Alternatively, the can plate is lifted by a suction stream directed upward into the upper filling position. The second moving device is then preferably made in form of a suction element which can be set on the can plate from above, for example, and which is then lifted with or without production of a closed negative-pressure space. Alternatively, the suction element is designed to be static and sucks the can plate upward by means of the suction stream, without moving itself. By adjusting the suction intensity, a slow lowering of the can plate during the filling process can be achieved.

In an alternative embodiment of the invention, a pulling element reaches from above into at least one opening in the can plate in order to move the can plate into the upper filling position. Such a pulling element comprises, e.g., a peg with an external worm gear which advantageously engages a central bore in the can plate so that the rotation of the peg can produce an up or down movement of the can plate. It is a requirement in that case that round cans with a large diameter in which the fiber sliver is deposited on the center be used. Alternatively, the pulling element can be designed in the form of a spreadable pin or as a balloon, the diameter of which can be enlarged beyond the diameter of the opening in the can plate once it has passed through it. In this manner, the can plate is carried along as the pulling element rises. Alternatively, the second moving element and the opening in the can plate are designed in the form of bayonet locks. In another alternative embodiment, the second moving element is made in the form of a spring hook and is spring-loaded. The spring advantageously releases the spring hook connection when a predetermined weight of the can plate and fiber sliver deposited on it is being exceeded.

In order to prevent the can plate from tipping over or even slipping out of the can, the lateral borders of the can plate are preferably extended downward in a vertical direction, beyond what is found in conventional embodiments.

Two embodiments of the invention given as examples are explained in further detail below through the drawing.

BRIEF DESCRIPTION OF THE DRAWINGS

FIG. 5 shows the rotary plate and the sliver can of FIG. 5 in a top view.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
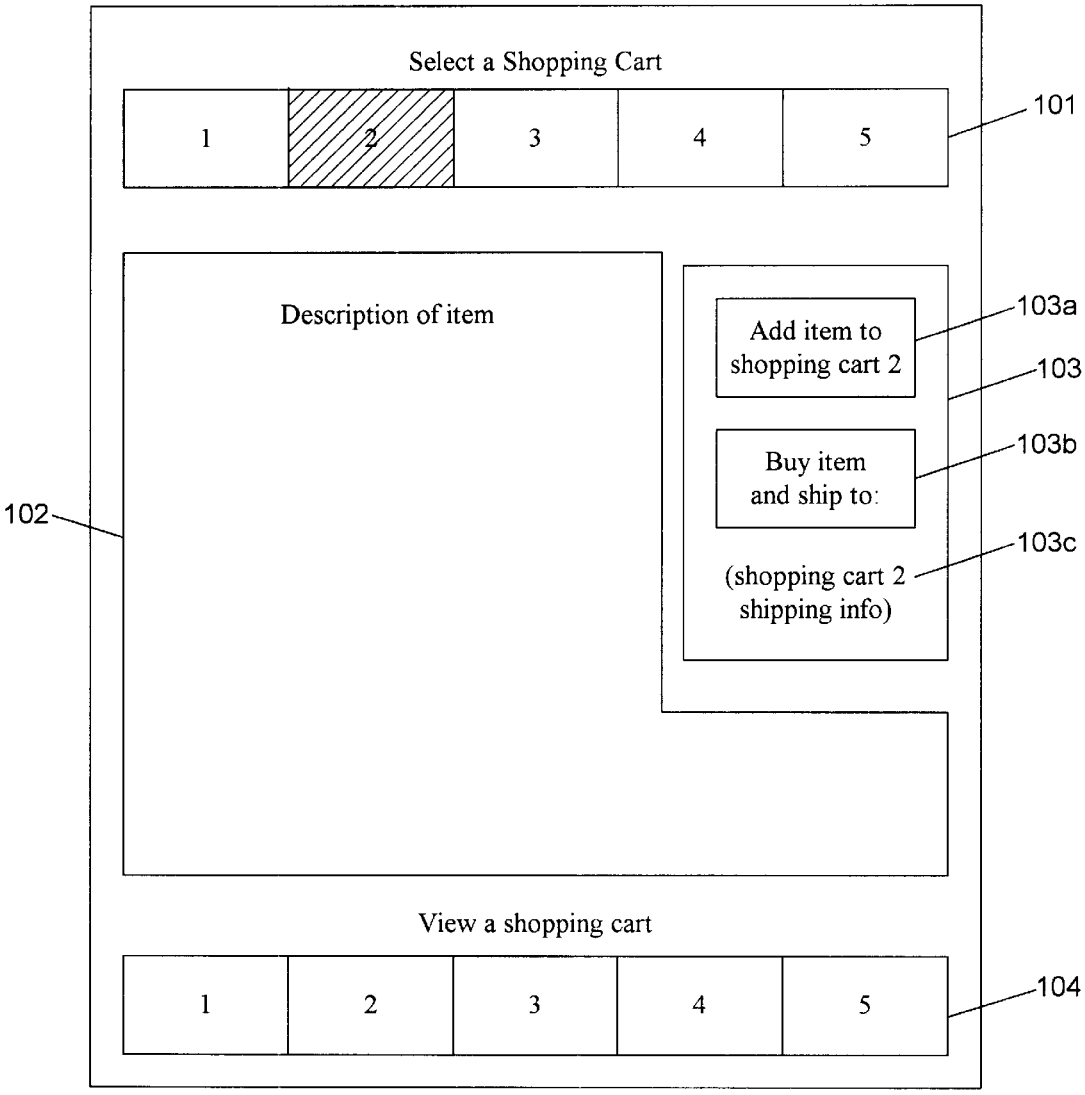
FIG. 1 shows a rotary plate at the output of a draw frame with a sliver can of small diameter placed below it in a schematic, partly cut-away lateral view.
Figure 2:
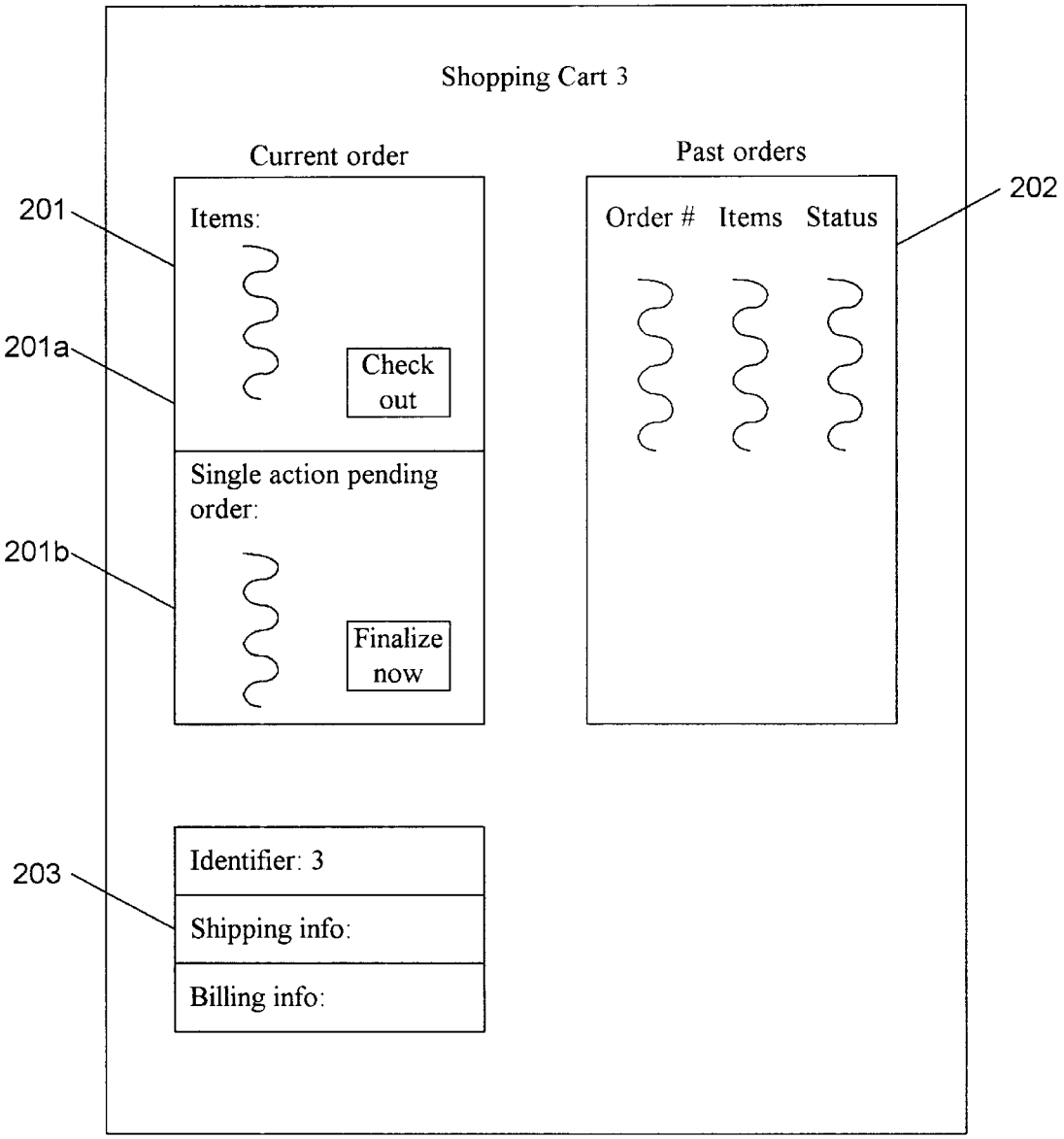
FIG. 2 shows the rotary plate and the sliver can according to FIG. 1, in a top view.
Figure 4:
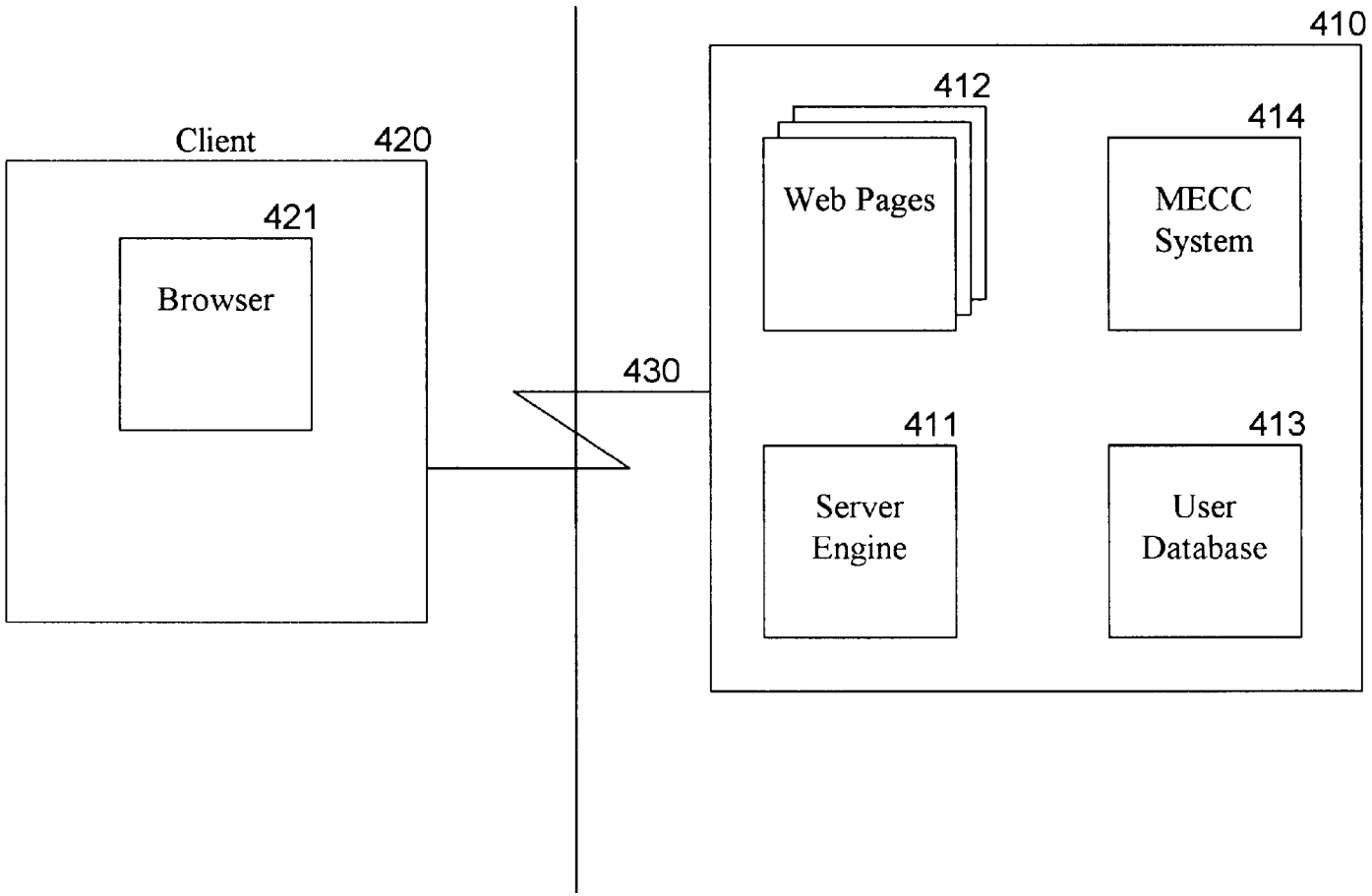
FIG. 4 shows a rotary plate at the output of a draw frame with a sliver can of large diameter placed below it, in schematic, partially cut-away lateral view.

FIGS. 1 and 2, as well as FIGS. 4 and 5, schematically show the output of a textile draw frame, in particular a rotary plate 1 and a sliver can 10 or 100 placed below the rotary plate 1 in a filling position and about to be filled. One or several presented slivers before the rotary plate 1 are drawn in the drafting equipment into one fiber sliver F of as uniform a diameter as possible, which is deposited by means of the rotary plate 1 in the sliver can 10, 100. Normally used sliver cans 10, 100 have either a round cross sections (so-called round cans) or a nearly rectangular cross-section (so-called rectangular cans). When a sliver can 10, 100 has been filled with the drafted fiber sliver, it is removed from its filling position and the next sliver can (10, 100) is placed beneath the rotary plate 1.

To ensure as efficient and even filling of the sliver can 10, 100 as possible, the rotary plate 1 is provided with an open, usually curving breach which extends from a central upper opening to an eccentric lower opening through the rotary plate 1. A sliver channel is inserted in this breach—which could also be interrupted—and the fiber sliver runs through this sliver channel on its way to the sliver can 10, 100. In FIGS. 1 and 4, only the axis line 5 of this sliver channel is shown. The rotary plate 1 and the end of the sliver channel on the side of the can are at a vertical distance from the can edge 13, so that sufficient room is left in the vertical direction for the fiber sliver emerging from the sliver channel.

Figure 3:
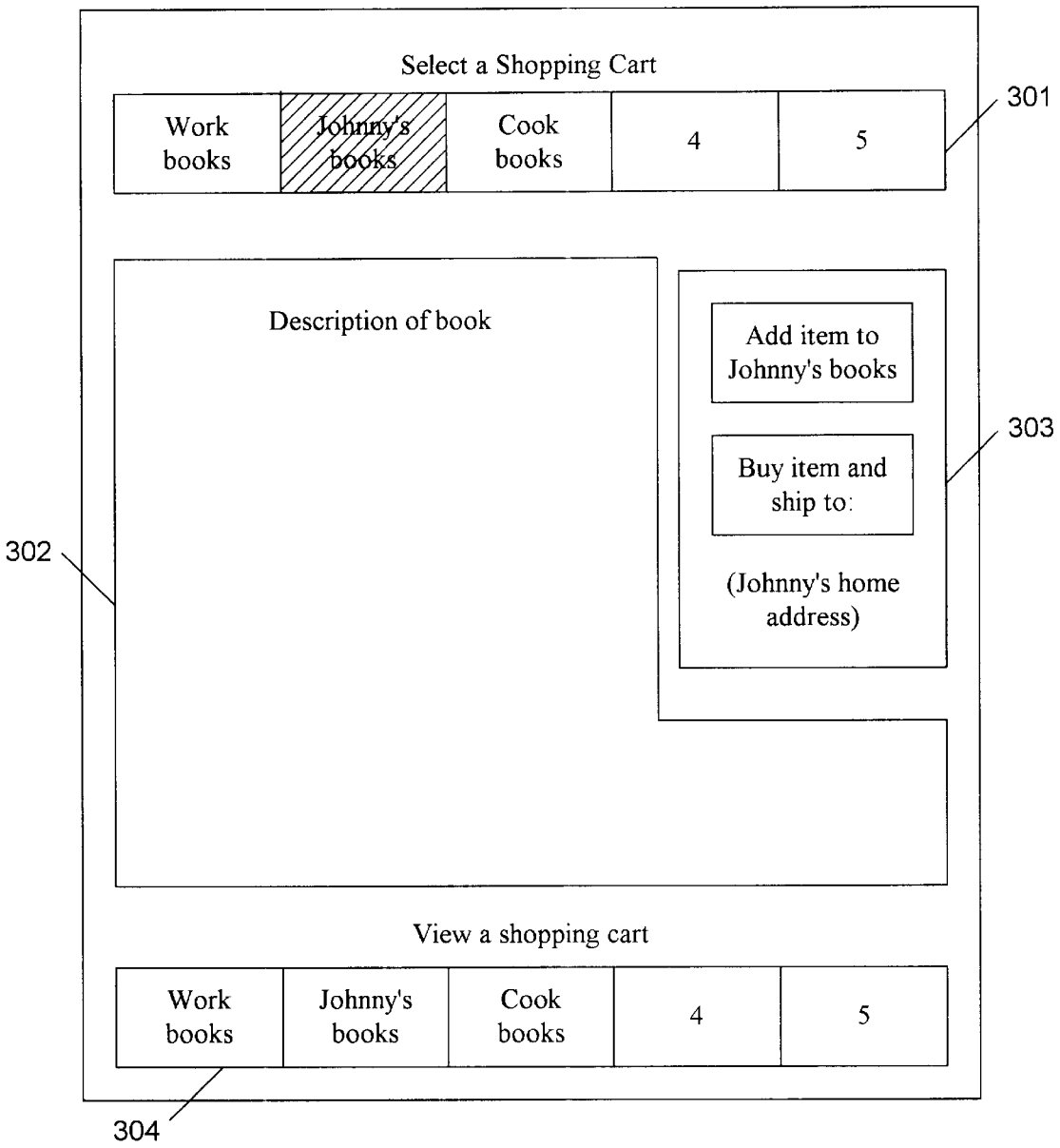
FIG. 3 is a schematic drawing of a fiber sliver depositing system across the center.
Figure 6:
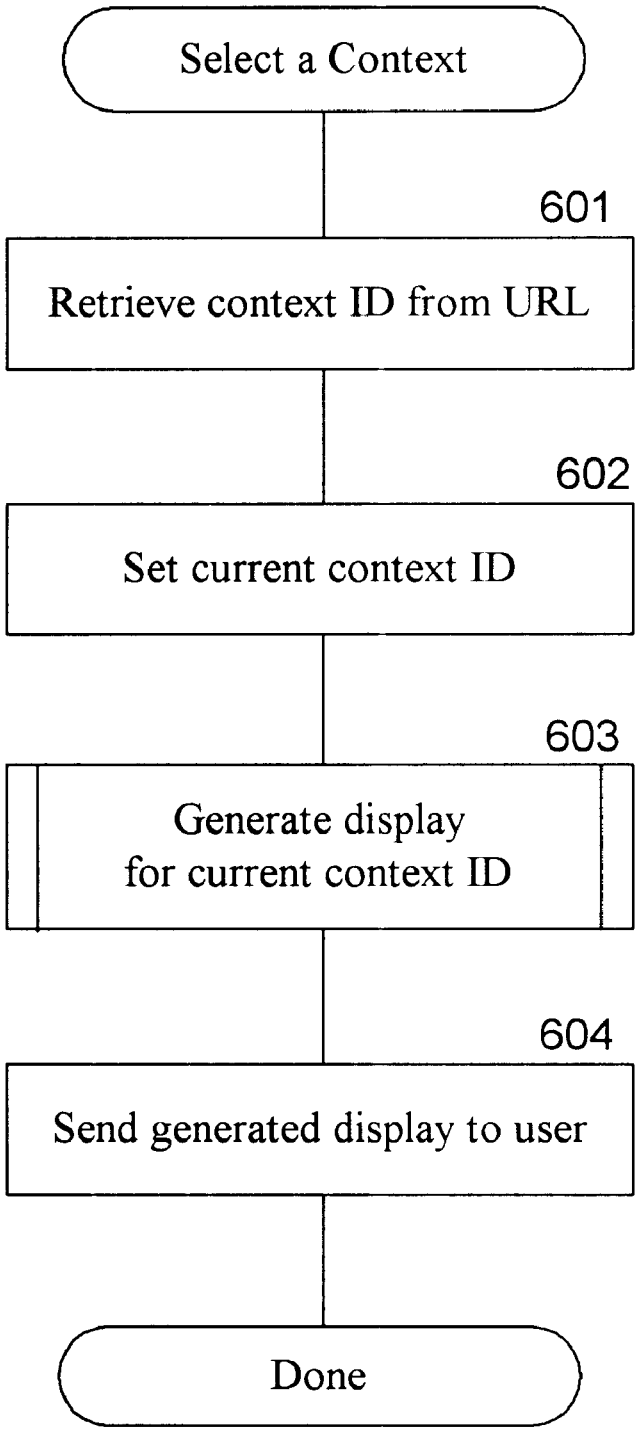
FIG. 6 is a schematic drawing of a fiber sliver deposit on the center.

Usually, the fiber sliver is deposited in a cycloidal fashion in the sliver cans 10, 100. For this, the fixed rotational or vertical axis 4 of the rotating rotary plate 1 and the fixed rotary or vertical axis 20 of the also rotating sliver can 10, 100 are offset relative to each other. In cans 10 with relatively small diameter (FIGS. 1 and 2), the end of the fiber sliver channel rotating together with the rotary plate 1 which discharges the fiber sliver F then sweeps across the rotational axis 20 of the sliver can 10. This results in a so-called sliver deposit over the center (see FIG. 3). With a larger sliver can 100 with a greater diameter (FIGS. 4 and 5), the sliver channel does however not sweep over the rotational axis 20 of the can. This is called a deposit to center (see FIG. 6).

The sliver can 10 of FIGS. 1 and 2 has a can diameter DK (see FIG. 3) of, e.g., 450 mm. The sliver can 100 of FIGS. 4 and 5 has a can diameter DK of, e.g., 1000 mm. The deposit diameter A of the fiber sliver loops is greater for a deposit in a can 10, according to FIGS. 1 and 2, than one half of the can diameter DK, and smaller in case of a deposit in a can 100, according to FIGS. 4 and 5, than one half of its diameter DK.

The sliver cans 10, 100 with round cross sections shown in the figures have lateral walls 11 and a bottom wall 12. The cans 10, 100 are open at the top and have an upper edge 13 going all around. A can plate 14 is installed in the sliver can 10, 100 and has a horizontal depositing surface 15 and a circumferential lateral can plate wall 16 crimped off the depositing surface 15.

The can plate 14 is designed so as to be capable of moving vertically inside the sliver can 10, 100. At the beginning of the filling process, the can plate 14 must be as close as possible to the upper can edge 13 in order to ensure an orderly depositing of the sliver on the depositing surface 15. In other words, this means that the friction between the fiber sliver and the depositing surface 15 must be suitably coordinated. The first moving devices 17 which are made in the form of helicoidal springs in the shown embodiment accomplish this task at least in part. In the figures, only the upper spring segments are shown. During the filling process, the spring 17 is pushed together against its spring force by the weight of the can plate 14 and of the fiber sliver deposited on it. The can plate 14 is moved into a lower can plate position. The full can 10, 100 is then conveyed to a textile machine, e.g., an open-end sliver machine for further treatment. There, the fiber sliver F is gradually taken out again from the can 10, 100. During this process, the can plate 14 moves back up into a higher can plate position under the effect of the spring force acting from below to be then again moved to the pre-processing draw frame to be thereupon filled again.

In order to bring the can plate 14 into an optimal position at the upper edge 13 of the can and thus to achieve sufficient frictional engagement for the fiber sliver to be deposited, a second moving device 9 according to the invention made in the form of a magnet is provided for the embodiment of FIGS. 1 and 2. This magnet 9 is ring-shaped and is centrally inserted into an opening 3 in the rotary plate 1, which is also centered relative to the rotational axis 4. The magnet 9 is flush with a lower cover plate 2 on the rotary plate 1.

A can plate movement element, illustrated here as magnet 19, is also installed on the underside of the can plate 14. This magnet has a smaller diameter than the can 10 and has a polarity opposite to that of the magnet 9. The magnet 19 is inserted, e.g., from the top into the depositing surface 15 of the can plate 14 and is glued or snapped in. The placement of machine-side magnets 9 and can-side magnets 19 relative to each other is such that at least parts of the two magnets 9 and 19 are directly one above the other at any point in time during the filling process. In this way, a controlled lifting force is exerted upon the can plate 14, enabling it to move into the upper filling position. The can plate 14 is shown in this filling position in FIGS. 1 and 4.

One end of a retaining cord serving as a distance holder 18 is attached to the underside of the can plate 14. Its other end is attached on the inside to the bottom wall 12 of the can. When taut, the cord 18 nearly closes the depositing surface 15 of the can plate 14 so that it is flush with the upper edge 13 of the can. This arrangement prevents the magnet 9 from lifting the can plate 14 out of the can 10. In addition, to prevent jamming of the can plate 14 in the sliver can 10, the lateral walls 16 of the can plate 14 are extended relatively far down.

The functioning of the second moving device or magnet 9 in interaction with the can-side magnets 19 is as follows. The spring 17 moves the can plate 14 into a higher position than the lower can plate position. Mainly due to fatigue of the spring 17, it often happens that the can plate 14 is not moved as desired into the upper filling position, i.e., to the upper edge 13, but only to a lower position. According to the invention, the can plate 14 is moved from this position into the upper filling position, by means of the magnet arrangement 9, 19. In this upper filling position, a sufficient frictional engagement is ensured between the can plate 14 and the fiber sliver segment to be deposited on it, when the can 10 is still empty or almost empty. Fine-tuned positioning of the can plate 14 thus makes it possible for the fiber sliver end to be deposited in an orderly manner in the can 10.

A lowering of the can plate 14 can also be achieved by means of the apparatus according to the invention, e.g., when the spring 17 in the sliver can 10, 100 is too strong and pushes the can plate 14 slightly out of the sliver can 10, 100 (when no retaining cord 18 is provided or when it is too long).

The can 100, according to FIGS. 4 and 5 in which the fiber sliver F is deposited around the center because of its greater diameter, is quite similar to can 10 according to FIGS. 1 and 2 in its construction. A magnet 19 is also attached from below to the can plate 14. By contrast with the embodiment of FIGS. 1 and 2, a magnet 109 in the form of a stamp is placed centrally relative to the rotational axis 20 of the can 100 on the machine side. The machine-side magnet 109 and the can-side magnet 19 with opposing polarities are thus placed one above the other and centered relative to each other at any point in time during the filling process.

The parts referenced as magnets 9, 19, 109 can be magnetic or magnetizable.

In the embodiment of the invention shown in FIGS. 4 and 5, the magnets 109 and 19 are frictionally engaged with each other. This means that the stamp must be capable of rotating in order to follow the rotational movement of the can 100. In an alternative embodiment of the invention not shown here, the two magnets 109 and 19 are placed at a distance from each other. In that case, the magnet 109 can be non-rotatable.

In the embodiment of the invention shown in FIGS. 4 and 5, the magnet 109 can be moved vertically (see double arrow). Thereby, the second moving device can be moved from above to within close proximity of the can plate 14, so that it can interact with the latter and can then bring it into the upper filling position. A vertical mobility of the magnet 9—generally the second moving device—can of course also be provided with the embodiment according to FIGS. 1 and 2.

The second moving device 9, 109 can be used not only to move the can plate 14 into its upper filling position but can assume also additional functions. For example, a force influence exerted by the second moving device can be maintained at least during the starting phase of the can filling process during which the can plate 14 must descend slowly as it is being filled. The can plate 14 is advantageously still subjected to a force of the second moving device during the first few centimeters. This force remains then either constant or is reduced or increased gradually, depending on the prevailing force relationships determined by the weights of the can plate and the fiber sliver deposited on it, as well as by the forces exerted by the first and second moving device. In this case sensors (not shown), e.g., weight sensors, as well as a control or regulating system (not shown) are advantageously used. The goal consists of producing optimal frictional forces between the material being deposited and the depositing support during sliver deposit. The support is constituted by the depositing surface 15 in the still empty sliver can 10, 100 and by the uppermost fiber sliver loops in an already partially full sliver can 10, 100. The frictional forces may not be too weak, as is often the case in the state of the art with a fatigued spring. However, the frictional forces may also not be too great. This would be the case, for example, if the force of the second moving device were too great after the start of the filling process for the can plate 14 to descend sufficiently.

For a can already partially full, only the first moving device is used in order to compensate for the weight of the can plate 14 and the deposited fiber sliver. With the use of one or several springs 17, the can plate 14 moves either out of the force field of the second moving device 9, 109 or the force exerted is actively switched off once the can plate 14 has been lowered over a predetermined distance or when the weight of the can plate 14 and the deposited fiber sliver F have reached a predetermined value.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for adjusting a can plate of a sliver can to a level filling position to accept sliver from a textile machine during a beginning of a filling process, the process comprising of the steps of:

moving the can plate of the sliver can from a lower position to a higher position by a first moving device before the filling process;

positioning the sliver can in a filling location of the textile machine to allow the textile machine to fill the sliver can with sliver; and adjusting the can plate of the sliver can to the filling position from the higher position of the can plate by a second moving device to ensure proper positioning of the can plate for the accepting of the sliver.

2. A process as in claim 1, wherein the second moving device subjects the can plate to an additional force.

3. A process as in claim 2, wherein the additional force of the second moving device is magnetic.

4. A process as in claim 2, wherein the additional force is a non-physically contacting force that acts on the can plate.

5. A process as in claim 2, wherein the additional force exerted by the second moving device gradually decreases as the can plate lowers due to filling of the sliver can with sliver until the additional force is stopped.

6. A process as in claim 2, Wherein the additional force exerted by the second moving device is stopped once the can plate moves a predetermined distance from the filling position.

7. A process as in claim 2, wherein the additional force exerted by the second moving device is stopped when the weight of sliver deposited on the can plate exceeds a predetermined weight.

8. A process as in claim 2, wherein the additional force exerted by the second moving device acts on a supporting element of the can plate.

9. An apparatus for ensuring proper acceptance of sliver produced from a textile machine into a sliver can at a beginning of a filling process, said apparatus comprising:

a can plate operably disposed in said sliver can, said can plate for receiving sliver deposited on it by said textile machine;

a first moving device operably disposed to said can plate, said first moving device moving said can plate of said sliver can from a lower position to a higher position before the filling process and allowing said can plate to lower as said sliver can fills with sliver; and a second moving device operably engaging said can plate, said second moving device adjusting said can plate to a filling position from said higher position of said can plate to ensure proper positioning of said can plate for accepting said sliver from said textile machine.

10. An apparatus as in claim 9, wherein said second moving device is operably disposed to said textile machine.

11. An apparatus as in claim 10 wherein said second moving device is operably disposed to a rotary plate at an output of a textile machine.

12. An apparatus as in claim 10, wherein said second moving device is operably disposed next to a rotary plate at an output of a textile machine and above said can plate in such a manner that said second moving device engages said can plate in a vicinity of a vertical axis of said sliver can.

13. An apparatus as in claim 9, wherein said second moving device is movable in a vertical direction.

14. An apparatus as in claim 9, wherein said second moving device is movable in a horizontal direction.

15. An apparatus as in claim 9, wherein said second moving device is movable in vertical and horizontal directions.

16. An apparatus as in claim 9, wherein said first moving device includes a helicoidal spring acting upon said can plate from below said can plate.

17. An apparatus as in claim 9, wherein said first moving device includes an external lifting device to move said can plate.

18. An apparatus as in claim 9, wherein said second moving device is operably disposed outside of said sliver can.

19. An apparatus as in claim 9, further comprising a can plate movement element operably disposed to said can plate, said can plate movement element being engaged by said second moving device to adjust said can plate to said filling position.

20. An apparatus as in claim 19, wherein said second moving device and said can plate movement element are magnetic or magnetizable.

21. An apparatus as in claim 9, further comprising a distance holder operably disposed to said can plate and said sliver can, said distance holder preventing said can plate from moving above a set level in said sliver can.

22. An apparatus as in claim 21, wherein said distance holder is a cord.

23. An apparatus as in claim 9, wherein said second moving device physically contacts said can plate and rotates as said sliver can and said can plate rotate while said second moving device engages said can plate during said filling process.

24. An apparatus as in claim 9, wherein lateral sides of said can plate are extendable downward in a vertical direction.

* * * * *

UNITED STATES PATENT AND TRADEMARK OFFICE

CERTIFICATE OF CORRECTION

PATENT NO. : 6,588,194 B2
APPLICATION NO. : 10/044308
DATED : July 8, 2003
INVENTOR(S) : Kriegler et al.

It is certified that error appears in the above-identified patent and that said Letters Patent is hereby corrected as shown below:

On The Title Page
Item (30) Foreign Application Priority Data
October 21, 2000 (DE).....1 00 52 366.8

Signed and Sealed this

Twenty-ninth Day of August, 2006

JON W. DUDAS
*Director of the United States Patent and Trademark Office*